United States Patent [19]

Menconi et al.

[11] 4,436,779

[45] Mar. 13, 1984

[54] MODULAR SURFACE SUCH AS FOR USE IN SPORTS

[76] Inventors: K. Anthony Menconi, 6835 County Line La., Burr Ridge, Ill. 60521; Joseph F. Gribauskas, Jr., 21 W. 246 Audubon Rd., Lombard, Ill. 60148

[21] Appl. No.: 394,528

[22] Filed: Jul. 2, 1982

[51] Int. Cl.[3] ..... B32B 3/00

[52] U.S. Cl. ..... 428/169; 428/44; 428/45; 428/136; 52/177; 52/589; 52/593; 404/41; 404/42

[58] Field of Search ..... 428/44, 53, 131, 137, 428/169, 33, 45, 136; 404/36, 40, 41, 42; 52/177, 180, 581, 591, 589, 593

[56] References Cited

U.S. PATENT DOCUMENTS

| | | | |
|---|---|---|---|
| D. 238,065 | 12/1975 | Harvey . | |
| 3,438,312 | 4/1969 | Becker et al. . | |
| 3,616,104 | 10/1971 | Kuzmick . | |
| 3,909,996 | 10/1975 | Ettlinger et al. | 52/177 |
| 3,960,375 | 6/1976 | Bibi-Roubi et al. . | |
| 4,054,987 | 10/1977 | Forlenza . | |
| 4,244,761 | 1/1981 | Remi et al. | 428/169 X |

FOREIGN PATENT DOCUMENTS

| | | |
|---|---|---|
| 1438240 | 7/1966 | France . |
| 2428706 | 1/1980 | France . |

*Primary Examiner*—Alexander S. Thomas
*Attorney, Agent, or Firm*—Leydig, Voit, Osann, Mayer & Holt, Ltd.

[57] ABSTRACT

A modular surface having an important use as a sports deck, and particularly for ball sports like tennis. The surface is built up of a number of generally square tiles in which the play surface is supported by a large number of support pegs intended to rest on an undersurface. The tiles are flexible so that the support pegs can remain in contact with the undersurface even if it is not perfectly plane, assuring consistent ball bounce. A special arrangement of expansion joints gears the ability of the tile to absorb expansion and contraction resulting from temperature changes to the geometry of the tile to: (a) keep the pegs on the ground even in the presence of temperature changes to assure consistent ball bounce, and (b) keep the play field itself from expanding or contracting without the need for anchoring it to the undersurface.

13 Claims, 11 Drawing Figures

MODULAR SURFACE SUCH AS FOR USE IN SPORTS

This invention relates to modular surfaces, and more particularly to such surfaces intended to remain in good contact with an underlying surface without the need for attachment thereto.

Such surfaces have a number of uses, and a relatively significant one is sports decking. Ball sports in particular, such as tennis, present a fairly exacting application. The following specification will treat the modular surface as useful for tennis courts, but will conclude with alternative constructions and applications.

Many modular surfaces of the type considered herein are installed over old courts in need of repair. It is typical, therefore, to expect some imperfections in the undersurface supporting the modular surface. For that reason, as well as for the purpose of providing a resilient surface, many systems support the play surface on a large number of support posts. The tiles are sufficiently flexible to keep the posts in contact with the undersurface while accommodating some imperfections in the undersurface.

The materials used for modular surfaces have typically exhibited a significant degree of expansion and contraction with temperature change. A significantly rapid temperature change can actually cause the individual tiles, and therefore the surface which they make up, to buckle. At a minimum, if the tiles start to buckle, some of the support posts will lift from the undersurface, causing erratic ball bounce and bad play. If the problem becomes major, the surface buckling can actually cause the court to become unplayable until the tiles accommodate themselves to the new temperature level and again flatten out.

Several approaches have been taken to the temperature related dimension change problem, with varying degrees of success. Attempts have been made to actually anchor the modular surface to the undersurface in order to keep it in place. Expansion joints of various kinds have been used with only limited success. Stretch installation techniques have been suggested for keeping all tiles under tension by exerting tension around the entire periphery. The raw material from which the tiles have been molded has been altered to reduce its thermal coefficient of expansion. In summary, however, we are unaware of any prior modular surface which requires no anchoring or stretch installation, yet remains flat over the substantial temperature range which can be achieved in practicing the present invention.

We have discovered that a non-anchored system can be provided with an enhanced ability to remain flat and in contact with the undersurface if the geometry of the expansion joint system is geared to the tile geometry.

Accordingly, it is a general aim of the present invention to provide a non-anchored modular surface and the modules thereof which, if square under normal conditions, remains essentially square even under conditions of comparatively rapid temperature change.

An object of the present invention is to provide a module for a non-anchored modular surface which, although easy to install, provides superior play characteristics over an extended temperature range.

In accomplishing that aim, it is an object to provide a modular surface having an expansion joint geometry in each module adapted to retain the square shape of the module, such that a surface including a large number of interlocked modules also remains flat and unbuckled.

Other objects and advantages will become apparent upon consideration of the following specification when taken in conjunction with the drawings in which.

Figure 5:
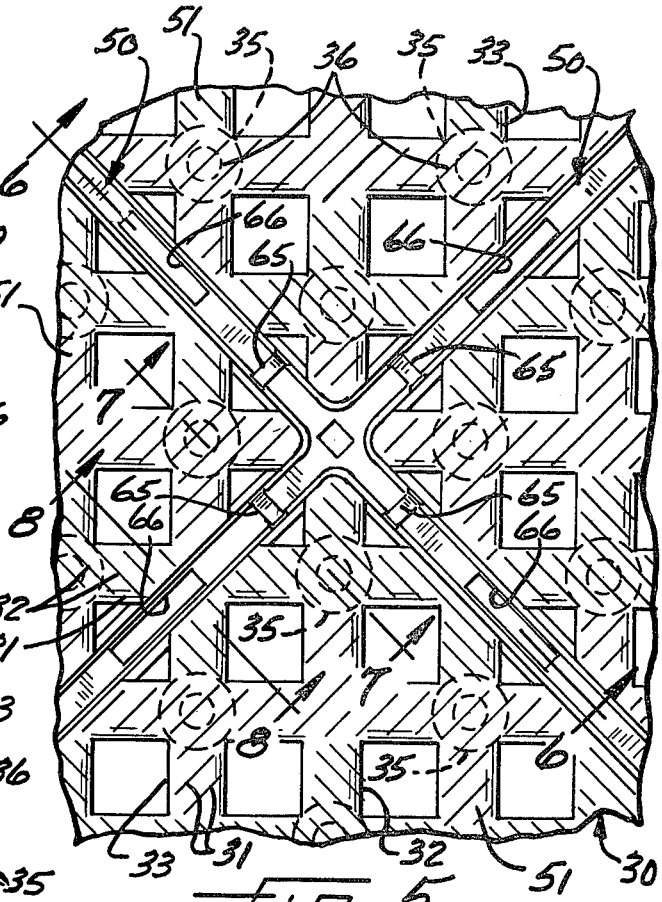
FIG. 5 is an enlarged partial view showing a portion of the tile surface including an expansion joint.
Figure 6:
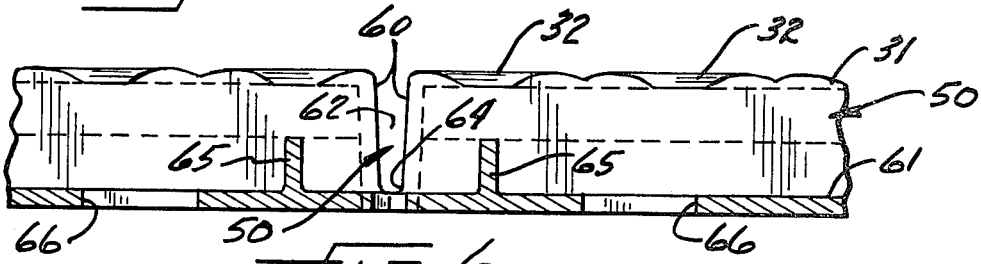
Figure 7:
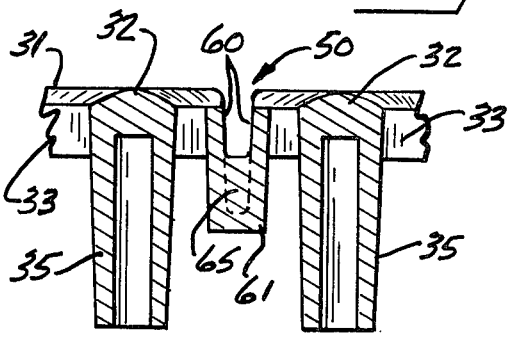
Figure 8:
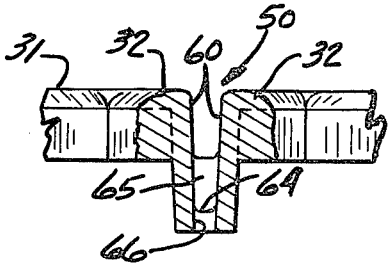
Figure 9:
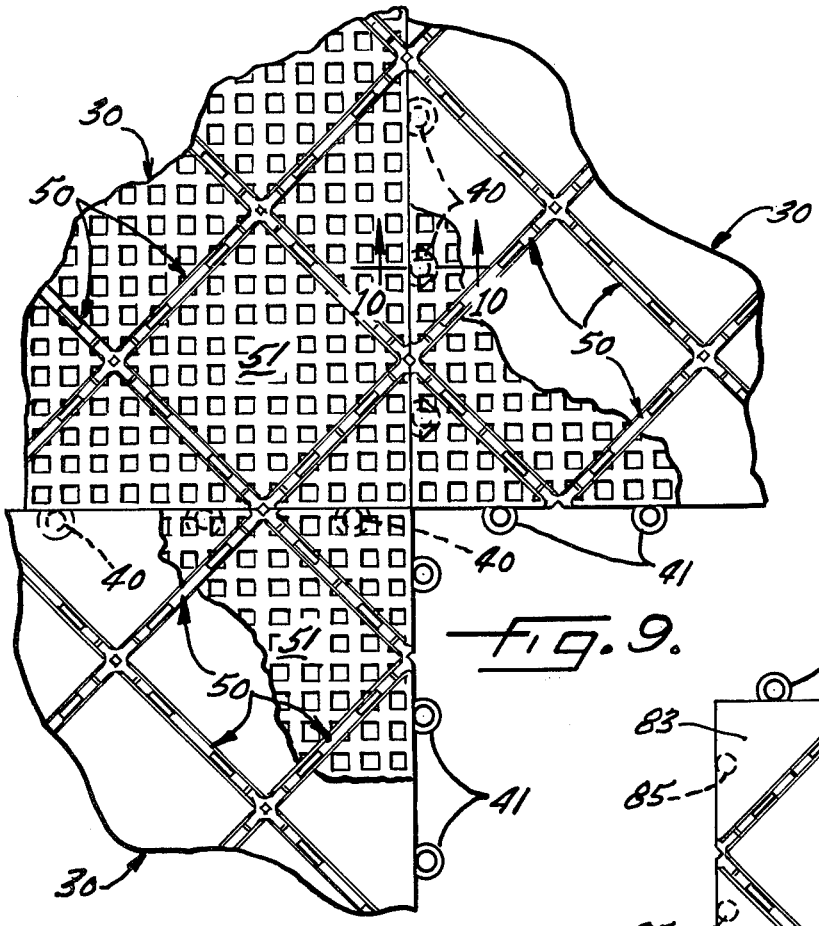
Figure 10:
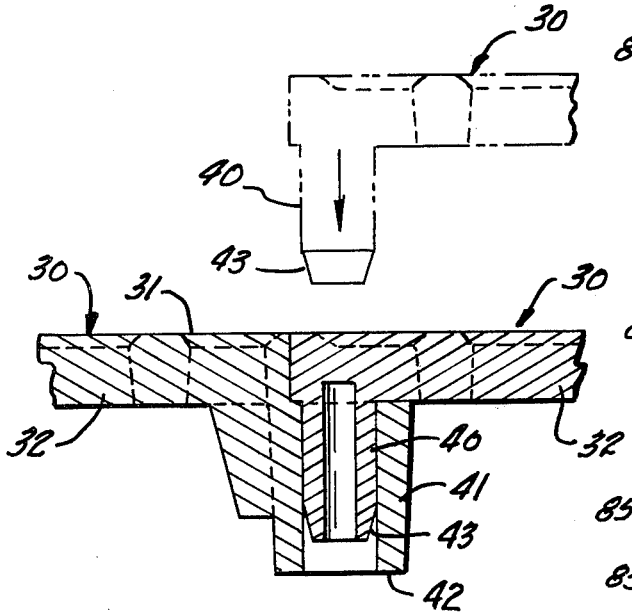
Figure 11:
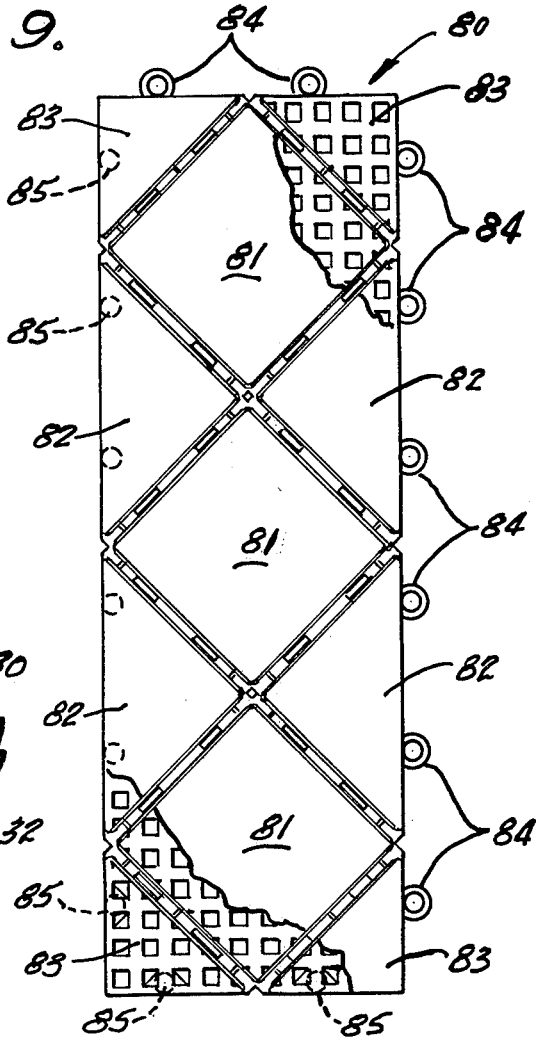

FIGS. 6, 7 and 8 are partial sectional views taken along the lines 6—6, 7—7 and 8—8, respectively, of FIG. 5;

FIG. 9 is a partial plan view showing a number of interlocked modules forming a modular surface;

FIG. 10 is a partial sectional view taken along the line 10—10 of FIG. 9 showing the interlocking means; and FIG. 11 is a plan view showing a sub-module.

While the invention will be described in connection with certain preferred embodiments, there is no need to limit it to those embodiments. On the contrary, the intent is to cover all alternatives, modifications and equivalents included within the spirit and scope of the invention as defined by the appended claims.

Figure 1:
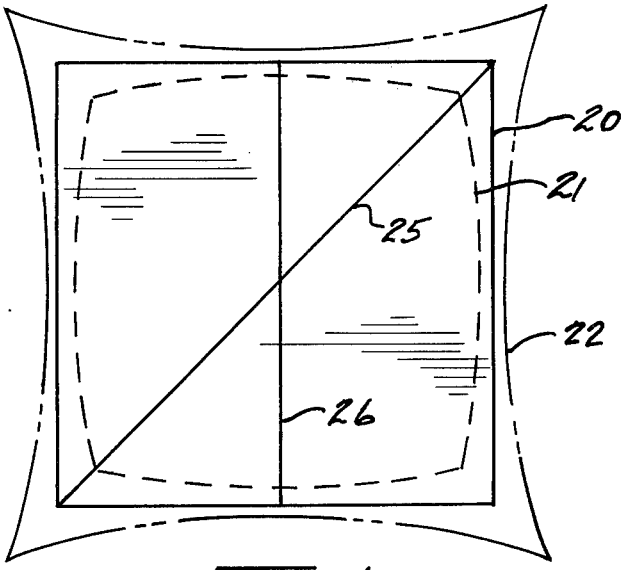
FIG. 1 is a diagram useful for explaining the temperature related dimensional changes of a tile.

Turning now to the drawings, FIG. 1 illustrates the general problem of expansion and contraction of a module, an understanding of which led us to the present invention. Outline 20 is intended to illustrate a perfect square which is the undistorted starting shape for a given module. Outlines 21 and 22 illustrate in very exaggerated fashion what might happen to the basic module 20 if constructed of material having a significant coefficient of thermal expansion when subjected to low and high temperatures respectively. Expansion or contraction of the module along any linear dimension generally follows the expression:

$$L = L_0(1 + \alpha \Delta T)$$

where L is the new length, $L_0$ is the starting length, $\alpha$ is the thermal coefficient of expansion, and $\Delta T$ is the temperature change. Thus, for any temperature change $\Delta T$, the expansion or contraction is not constant for the various directions, but is proportional to the original dimension. Returning to FIG. 1, it is seen that the longest tile dimensions are the diagonals, one of which is illustrated at 25. That dimension is obviously substantially greater than any "perpendicular dimension" (i.e., one perpendicular to any tile edge) by a factor of 1.414. Thus, with no provision for accommodating dimensional changes caused by thermal expansion of contraction, if the module 20 is subjected to a sharp temperature increase, the diagonal 25 will expand to a greater degree than say perpendicular 26, causing the tile to assume a shape like the outline 22. Similarly, if the tile is caused to undergo a sharp temperature decrease, the diagonal 25 will contract to a greater degree than say the perpendicular 26, causing the tile to assume a shape like outline 21.

In accordance with the invention, we have provided a tile with greater capacity to accomodate thermal expansion and contraction on the diagonals than on the perpendiculars so that the tile tends to remain square, like outline 20, even when subjected to significant temperature changes and significant rate of change of temperature.

It should be noted here that some prior expansion joint designs for modular surfaces have included expansion joints which would allow the surface to lay flat over a relatively wide range of temperatures. However, with expansion joints not properly geared to the geometry of the tile, those surfaces exhibited a problem in the short run, when the temperature changed at a relatively rapid rate. Thus, the surface would tend to lift and buckle as the temperature was changing, but would ultimately equilibriate at the new temperature and return to the flattened condition. In some cases, the surface has been known to be unplayable for a period of several hours before accommodating itself to the new temperature level.

Figure 2:
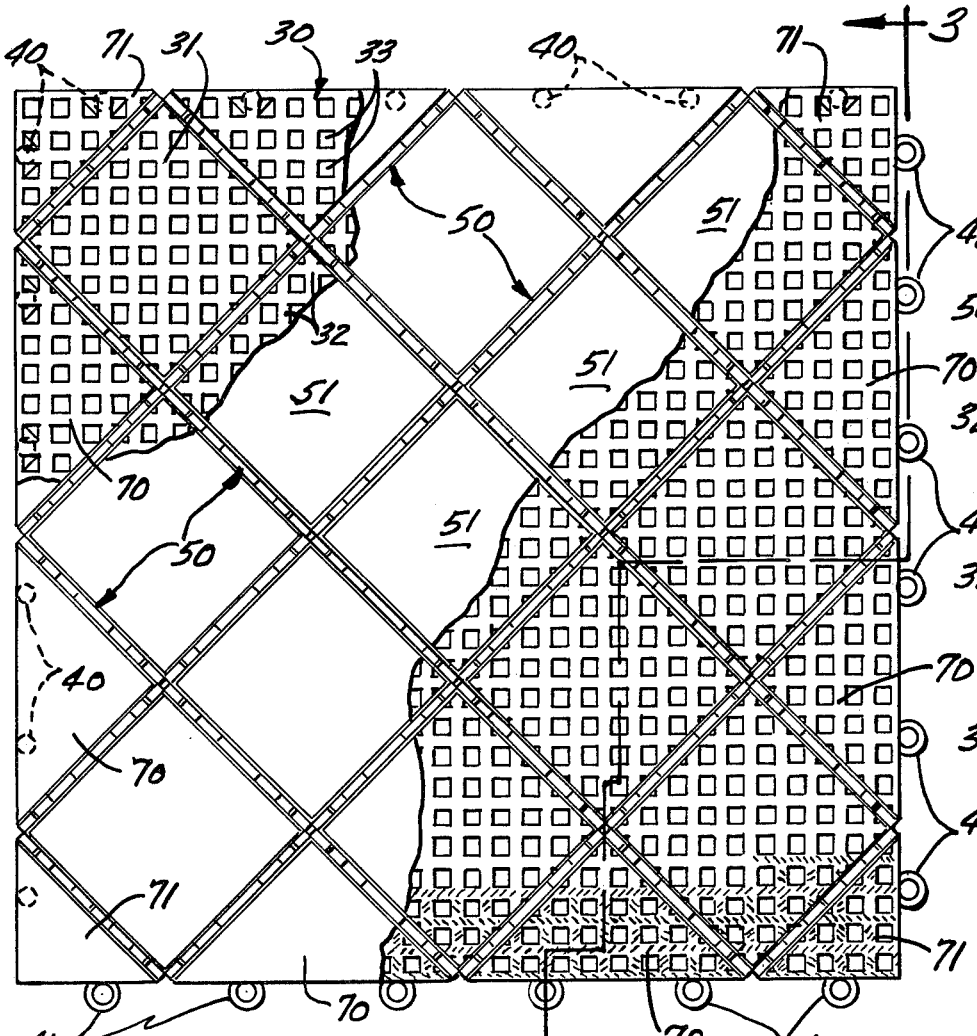
FIG. 2 is plan view showing a single module exemplifying the present invention.

Turning to FIG. 2, there is shown one module 30 exemplifying the present invention which can be interlocked with a number of similar modules to form a modular surface. Typically, the module is a square measuring about one foot on a side, and when used for a single tennis court is interlocked with similar modules to cover an area of about 60 by 120 feet.

In the illustrated embodiment, the play surface 31 (FIG. 3) is a perforate grid-like structure with ribs 32 forming apertures 33. The play surface can be textured as desired to provide desired frictional characteristics both with respect to traction for the players as well as appropriate frictional characteristics for ball spin.

Figure 3:
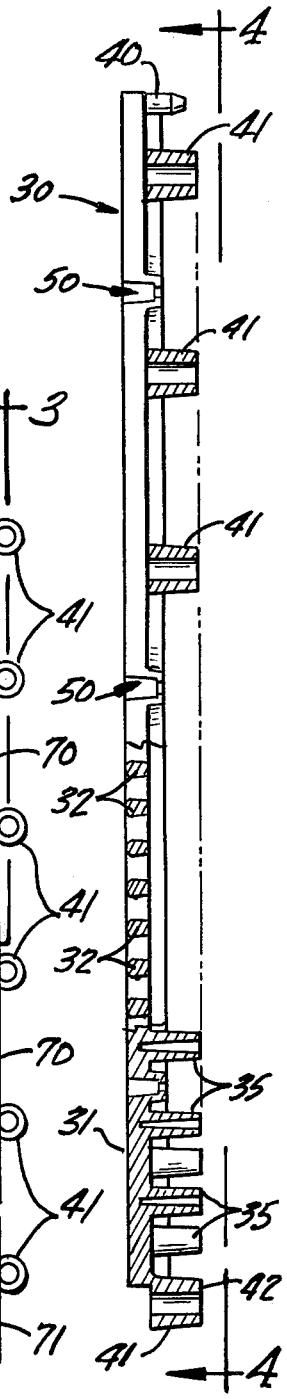
FIG. 3 is a section taken along the line 3—3 of FIG. 2.
Figure 4:
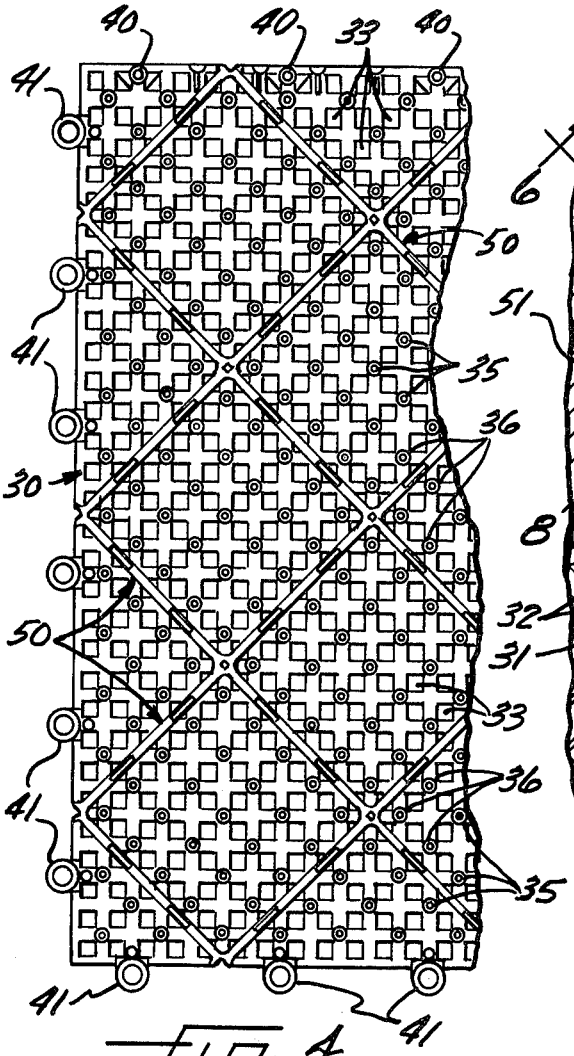
FIG. 4 is a partial sectional view taken along the line 4—4 of FIG. 3 showing the underside of a tile.

As best shown in FIGS. 3 and 4, the underside of the tile is provided with support means, in the illustrated embodiment comprising a plurality of posts or pegs 35. FIG. 4 demonstrates that the pegs 35 are affixed to the underside of the play surface 31 at a selected number of junctions 36 between the ribs 32. The lower end of the pegs 35 thereby define the areas for contact between the tile 30 and the undersurface. Due to the flexibility of the tile, it is possible to accommodate some surface imperfections in the undersurface. It is important, however, to maintain all of the pegs in contact with the undersurface. If a comparatively small area of the tile has a number of pegs out of contact with the support area, it will represent a "dead spot" in the surface having a ball bounce characteristic much weaker than properly laid sections of the surface.

For the purpose of interconnecting the modules, each edge has associated therewith interlocking means shown in the illustrated embodiment as a plurality of posts 40 along two of the edges and a corresponding plurality of mating receptacles 41 along the other two edges. FIG. 9 illustrates the manner in which a plurality of tiles are assembled by interlocking the posts 40 within associated receptacles 41. FIG. 10 illustrates in greater detail a post 40, prior to insertion in dashed lines and interlocked in full lines. The lower surface 42 of the receptacle 41 is in the same plane as the lower surfaces of the pegs 35, such that the surface 42 also provides support for the tile. The lower portion of the post is beveled at 43 and, if desired, the upper portion of the receptacle 41 can be chamfered to assist interlocking. FIG. 10 illustrates the close fit achieved by the interlocking means which presents an appearance which is almost seamless.

In accordance with the invention, the tile 30 is provided with an expansion joint system geared to the geometry of the tile, and adapted to cause the tile to retain its square shape even in the presence of rapid temperature changes. Referring to FIG. 2, it is seen that a plurality of expansion joints 50 divide the play surface 31 into a plurality of diamond shaped pads 51 separated by the expansion joints 50. The diamonds 51 are actually squares, but are referred to as diamonds herein because they are oriented with their sides either perpendicular to or parallel to the diagonals of the tile. That construction achieves the dual effect of (a) providing the greatest number of expansion joints along the longest dimension of the tile, the diagonal, and (b) orienting the expansion joints so that they are most effective along the longest dimension and least effective along the shortest dimension in order to retain the square shape of the tile even when subjected to temperature differentials.

It is seen in the exemplary embodiment of FIG. 2 that six full expansion joints are provided along the major tile diagonals, and those joints are perpendicular to the tile diagonal such that they are disposed to accommodate major expansion and contraction of the pads 51. The expansion joints disposed in that fashion for maximum effectiveness can be said to be "pointed". By way of contrast, expansion joints along any perpendicular can be thought of as being "blunted" because they are oriented to minimize accommodation for thermal expansion or contraction. The end result is that the pointed expansion joints along major dimensions and blunted expansion joints along minor dimensions counteract the tendencies discussed in connection with FIG. 1 to cause the tile to remain relatively square independent of temperature or temperature changes. Since the tile remains square, there is no tendency for the pegs to lift off the ground or for the tile to buckle; the modular surface truly becomes an all weather surface.

The details of an individual expansion joint are best illustrated with reference to FIGS. 5–8. FIG. 5 shows portions of four diamond-shaped pads separated by expansion joints 50. Each expansion joint includes a pair of depending segments 60 joined by a web 61 to form a channel 62 of sufficient dimension to absorb thermally induced expansion of the adjacent pads 51. As best shown in FIG. 7, the web 61 is slightly radiused at 64; the slight radiusing causes the tile to resist curling up on contraction. Each of the channels 60 also has a pair of ribs 65 in the lower portion thereof connected to both the depending segment 60 and the web 61. The ribs tend to provide a slight degree of additional stiffness to the tile without impairing the ability of the expansion joints to perform as intended, and in addition, also assist in preventing the tile from curling. As suggested by FIG. 2, two ribs per channel are adequate. Open sections 66 in the web 61 aid in preventing moisture or the like from accumulating in the joint. In addition, as shown in FIG. 7, the support posts 35, which it is recalled are connected to the ribs at junctions thereof, position the web of the expansion joint above the level of the supporting surface. In addition, no pegs 35 are connected to the expansion joint, leaving it floating to maximize its effectiveness in performing its thermal control function.

Returning to FIG. 2, it is seen that the diamond shaped pads are symmetrically oriented with respect to the tile diagonals such that each expansion joint 50 is complete within a single tile, although multiple tiles can be used to make up an individual square pad. Thus, along each tile edge there are half diamonds 70 which cooperate with similar half diamonds on the adjacent tile to form a full diamond, each tile contributing two expansion joints to that arrangement. Similarly, at tile corners there are quarter diamonds 71 such that four associated tiles are required to make up a full diamond, with each tile contributing one expansion joint to that pad. Using such a symmetrical arrangement, and by configuring the tile so that each individual tile remains flat, assurance is given that the entire modular surface will also remain flat during temperature changes.

It is recognized that defining square pads with expansion joints parallel and perpendicular to diagonals of a square tile must require square pad portions along the tile edges; references herein to square pads and the like are intended to encompass such pad portions.

The location of the interlocking elements is also coordinated to the geometry of the expansion joint system for causing adjacent tiles to cooperate in maintaining the modular surface flat. Referring to FIG. 2, it is seen that each half diamond 70 has two interlocking sets disposed near the diamond corners where they can effectively make use of the associated expansion joints. Thus, a pair of interlocked tiles can transmit forces across the diamonds composed of two mating halves to open or close the expansion joints rather than lift the pegs off the ground.

In addition, each quarter diamond 71 has a set of interconnecting elements on each edge which tend to keep the quarter diamond from lipping-up and also serves to adequately transmit forces from four interlocked tiles to their four associated expansion joints to open or close the joints rather than lift the tile corners.

In some instances, it is desired to use a sub-module which is smaller than the full square module 30 illustrated in FIG. 2. In accordance with the invention, the expansion joint system described thus far is carried into the sub-module so that use thereof does not detrimentally affect the ability of the modular surface to remain flat. Referring to FIG. 11, a single sub-module 80 is illustrated which is just wide enough to include an integral number of full diamonds 81, in the illustrated embodiment the integral being 1. In addition, the tile at its edges has half diamonds 82 and at its corners quarter diamonds 83, such that it can fit into a modular system just as one of the full tiles. Associated with two of the edges are receptacles 84, and with the other two edges posts 85 for the purposes of interconnecting the sub-module into a system. Expansion joints 86 in the sub-module are configured exactly like those described in connection with the full tile. It will be apparent, therefore, that a line or row of sub-modules can be inserted into a modular system without disrupting the operation of the expansion joint system in maintaining flatness of the modular surface.

Tiles according to the present invention can be manufactured using conventional injection molding techniques. For the highest quality outdoor surfaces, we prefer to use an engineered alloy of rubber and polypropylene with appropriate pigments, ultraviolet stabilizers and the like known to the art. Where economy is a controlling factor, particularly for indoor courts, pool surrounds and the like, (or industrial uses such as fatigue pads) it is possible to use a less expensive polypropylene blend. Such a surface does not have the resilience of the preferred surface, (although it is sufficiently flexible to conform to an undersurface), nor are its thermal expansion and contraction characteristics quite as good. However, such a surface is adequate for many applications. Tiles constructed in accordance with the present invention are useful for sport surfaces, such as tennis courts, basketball courts and race fields both indoor and out. Not only can they be laid over "standard type" court bases, but they can be installed as rooftop courts and the like where it is not possible to use conventional construction. No anchoring is necessary, the surface is constructed by simply interlocking the tiles. The perforate play surface provides quick drainage so that the court can be played shortly after rainstorms.

After the court is in place, it provides a consistent resilient surface due to the material characteristics as well as the support on multiple pegs 35. Due to the thermal design of the tile, the pegs remain on the undersurface even in the presence of rapid temperature changes. If such a change occurs, the channels 62 between the pads 51 simply open or close to accommodate material size change without causing the tile to buckle. In addition, due to the mass of the overall system, thermal expansion and contraction is tolerated without changing the size of the surface, such that line positions are not affected by temperature.

We claim as our invention:

1. A module for a modular surface comprising a tile having an upper surface and a plurality of support means underlying the surface for engaging an undersurface, the tile being flexible to accommodate imperfections in the undersurface while keeping the support means in contact therewith, continuous floating expansion joints dividing the surface into square pads supported by said support means and oriented with diagonals generally parallel to the tile edges whereby the number and effectiveness of the expansion joints is greatest along the tile diagonal to maintain said support means in contact with the undersurface under conditions of changing temperature.

2. The module as set out in claim 1 wherein each expansion joint includes a floating web connecting the pads at a point below the upper surface but above the level of the undersurface established by the support means.

3. The module as set out in claim 2 wherein the web interconnects depending segments which are connected to the upper surface.

4. The module as set out in claim 3 wherein the web is thickened nearest the depending segments thereby to enhance the ability of the tile to keep the support means in contact with the undersurface during severe temperature decreases.

5. The module as set out in claim 3 or claim 4 wherein each expansion joint further includes rib means within the expansion joint connecting the web to the depending segments at spaced locations, thereby to enhance the flatness of the module.

6. The module as set out in claim 1 wherein the expansion joint is a channel having a pair of depending members connected by a web, the web being located intermediate the play surface and the undersurface engaging section of said support posts.

7. The module as set out in claim 6 wherein the web is radiused to resist curl on contraction.

8. The module as set out in claims 6 or 7 in which said expansion joint includes spaced ribs in the channel interconnecting the depending members and the web.

9. A module for a modular surface comprising a flexible tile having an upper surface, continuous expansion joints dividing the surface into diamonds with the expansion joints pointed along the module diagonals and blunted along module perpendiculars, support means for engaging an undersurface at a plurality of points to support said surface, said support means so constructed and arranged as to leave the expansion joints floating, and interlocking means for connecting a plurality of said modules, whereby said expansion joints are adapted to accommodate temperature changes while keeping said support means in contact with said undersurface.

10. A module for a modular surface comprising a flexible square tile having a perforate play surface, a plurality of continuous expansion joints dividing the play surface into a plurality of pads interconnected by the expansion joints at a level below said play surface, the pads being square in shape and oriented such that respective ones of the expansion joints are generally perpendicular to or parallel to the tile diagonal, support pegs connected to support the play surface but leaving the expansion joints floating, and interlocking means for connecting a plurality of the modules together, whereby the expansion joints are adapted to maintain the modular surface in a flat condition while accommodating temperature changes.

11. A module for a modular surface comprising a square flexible tile having a play surface, a plurality of continuous expansion joints dividing the play surface into separate pads separated by the expansion joints, support means underlying the play surface for support thereof, said support means being arranged to maintain said expansion joints in a floating condition between said pads, thereby to enhance the effectiveness of said expansion joints, the expansion joints being arranged to form pads which are square with respective expansion joints generally perpendicular to or parallel to the diagonal of the tile, whereby the largest number of expansion joints is positioned along the tile diagonal and oriented for maximum effectiveness along said diagonal to maintain the tile flat while accommodating temperature changes.

12. A modular surface comprising a plurality of square modules interconnected to form said surface, each module being a square tile having a plurality of support means for engaging an undersurface at a plurality of points to support said surface, each module also having a plurality of continuous floating expansion joints dividing said surface into a plurality of square pads supported by said support means and having diagonals generally parallel to the tile edges, whereby the number and effectiveness of the expansion joints is greatest along the tile diagonal to maintain the support means in contact with the undersurface under conditions of changing temperature.

13. The modular surface as set out in claim 12 wherein said surface further includes sub-module elements comprising an integral sub-multiple of said module including one or more full pads interspersed with pad portions divided along diagonals of the square pads, whereby said sub-modules can be interspersed in said modular surface without interferring with the pattern of said expansion joints.

* * * * *